US008228233B2

(12) United States Patent
Montag et al.

(10) Patent No.: US 8,228,233 B2
(45) Date of Patent: Jul. 24, 2012

(54) DIRECTIONAL ANTENNA AND METHODS THEREOF

(75) Inventors: Bruce C. Montag, Austin, TX (US); Khursheed Hassan, Austin, TX (US)

(73) Assignee: Dell Products, LP, Round Rock, TX (US)

( * ) Notice: Subject to any disclaimer, the term of this patent is extended or adjusted under 35 U.S.C. 154(b) by 163 days.

(21) Appl. No.: 12/767,399

(22) Filed: Apr. 26, 2010

(65) Prior Publication Data

US 2011/0260919 A1 Oct. 27, 2011

(51) Int. Cl.
*H01Q 3/02* (2006.01)

(52) U.S. Cl. ..... 342/374

(58) Field of Classification Search ..... 342/359, 342/371, 372, 374, 754, 757; 343/754, 757
See application file for complete search history.

(56) References Cited

U.S. PATENT DOCUMENTS 6,114,998 A 9/2000 Schefte et al.
6,133,880 A 10/2000 Grangeat et al.
6,243,046 B1 6/2001 Aoki
6,697,019 B1 2/2004 Hyuk-Joon et al.
7,034,761 B2 4/2006 Chiang et al.
7,218,282 B2 5/2007 Humpfer et al.
7,605,768 B2 10/2009 Ebling et al.
7,652,628 B2 1/2010 Zweers
7,855,696 B2 * 12/2010 Gummalla et al. ..... 343/876
2008/0204349 A1 8/2008 Shtrom et al.
2009/0028225 A1 * 1/2009 Runyon et al. ..... 375/219
2009/0109092 A1 4/2009 Mori
2011/0021166 A1 * 1/2011 Walley et al. ..... 455/132

* cited by examiner

*Primary Examiner* — Dao Phan

(74) *Attorney, Agent, or Firm* — Larson Newman, LLP

(57) ABSTRACT

A device includes, in one embodiment, first and second patch antennas. The first patch antenna is disposed at a dielectric substrate, and defines a first principle plane. The second patch antenna is disposed at the dielectric substrate, and defines a second principle plane, an orientation of the second principle plane being different from an orientation of the first principle plane. A switch is coupled to the first patch antenna and to the second patch antenna, the switch to select between operation of the first patch antenna and operation of the second patch antenna.

20 Claims, 5 Drawing Sheets

DIRECTIONAL ANTENNA AND METHODS THEREOF

FIELD OF THE DISCLOSURE

This disclosure generally relates to information handling systems, and more particularly relates to information handling systems having a wireless communication interface.

BACKGROUND

As the value and use of information continues to increase, individuals and businesses seek additional ways to process and store information. One option available to users is information handling systems. An information handling system generally processes, compiles, stores, and/or communicates information or data for business, personal, or other purposes thereby allowing users to take advantage of the value of the information. Because technology and information handling needs and requirements vary between different users or applications, information handling systems may also vary regarding what information is handled, how the information is handled, how much information is processed, stored, or communicated, and how quickly and efficiently the information may be processed, stored, or communicated. The variations in information handling systems allow for information handling systems to be general or configured for a specific user or specific use such as financial transaction processing, airline reservations, enterprise data storage, or global communications. In addition, information handling systems may include a variety of hardware and software components that may be configured to process, store, and communicate information and may include one or more computer systems, data storage systems, and networking systems.

An information handling system can include a communication interface for exchanging information with another information handling system. The communication interface can include a wireless interface utilizing radio signals to provide a data link between two or more information handling systems. The rate that information can be exchanged over a wireless data link is limited in part by the frequency of the radio signal used to carry the information, with higher frequencies generally capable of providing greater data throughput. For example, an extremely high frequency (EHF) wireless interface may operate at 60 gigahertz (GHz), a portion of the radio frequency spectrum known as the millimeter band.

BRIEF DESCRIPTION OF THE DRAWINGS

It will be appreciated that for simplicity and clarity of illustration, elements illustrated in the Figures have not necessarily been drawn to scale. For example, the dimensions of some of the elements are exaggerated relative to other elements. Embodiments incorporating teachings of the present disclosure are shown and described with respect to the drawings presented herein, in which.

The use of the same reference symbols in different drawings indicates similar or identical items.

DETAILED DESCRIPTION OF DRAWINGS

The following description in combination with the Figures is provided to assist in understanding the teachings disclosed herein. The following discussion will focus on specific implementations and embodiments of the teachings. This focus is provided to assist in describing the teachings and should not be interpreted as a limitation on the scope or applicability of the teachings. However, other teachings can certainly be utilized in this application.

Figure 1:
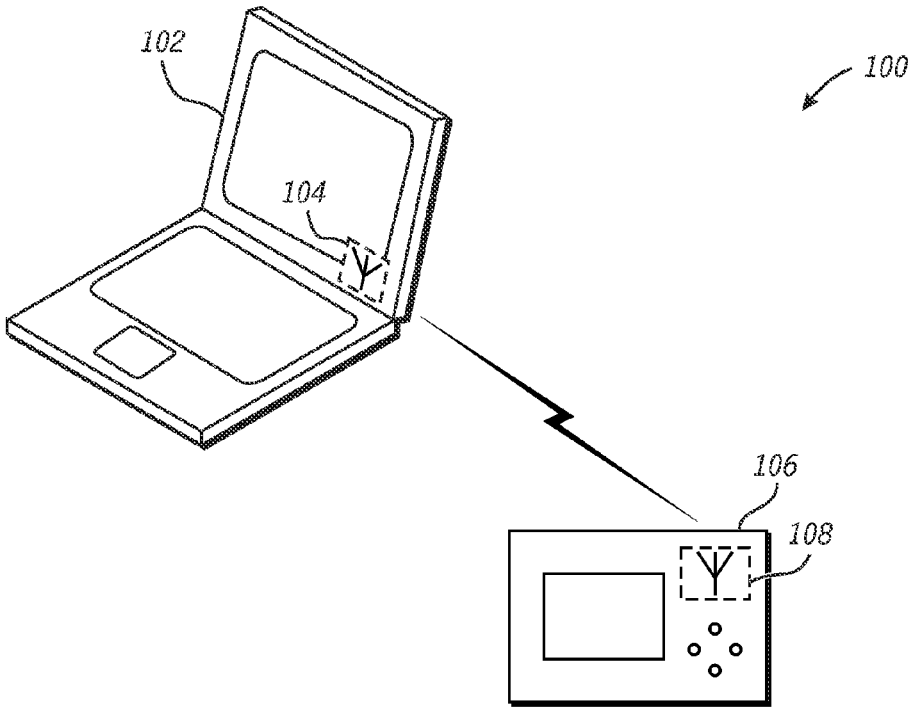
FIG. 1 is a diagram illustrating a wireless network system including two information handling systems, each information handling system having a corresponding antenna system in accordance with a specific embodiment of the present disclosure.

FIG. 1 shows a wireless network system 100 including two information handling systems 102 and 106, each information handling system having a corresponding antenna system in accordance with a specific embodiment of the present disclosure. For purposes of this disclosure, an information handling system may include any instrumentality or aggregate of instrumentalities operable to compute, classify, process, transmit, receive, retrieve, originate, switch, store, display, manifest, detect, record, reproduce, handle, or utilize any form of information, intelligence, or data for business, scientific, control, or other purposes. For example, an information handling system may be a personal computer, a network storage device, or any other suitable device and may vary in size, shape, performance, functionality, and price. The information handling system may include random access memory (RAM), one or more processing resources such as a central processing unit (CPU) or hardware or software control logic, ROM, and/or other types of nonvolatile memory. Additional components of the information handling system may include one or more disk drives, one or more network ports for communicating with external devices as well as various input and output (I/O) devices, such as a keyboard, a mouse, and a video display. The information handling system may also include one or more buses operable to transmit communications between the various hardware components.

Information handling system 102 includes an antenna system 104, and information handling system 106 includes an antenna system 108. For the purpose of example, information handling system 102 is shown as a laptop computer and information handling system 106 is shown as a personal data assistant (PDA). It should be appreciated, however, that devices and methods described herein can be incorporated at any type of information handling system and to provide wireless communication between any two or more information handling systems.

Information handling system 102 and information handling system 106 each include a wireless interface module as part of a network interface system (not shown at FIG. 1). A wireless interface module can be configured to both transmit and receive radio frequency signals and is thus capable of providing bidirectional communications with another information handling system having a similarly configured wireless interface. A wireless interface module also may be configured to provide only transmission or only reception if unidirectional data exchange is sufficient. An antenna system, such as antenna system 104, can be configured to transmit, receive, or both transmit and receive radio frequency signals.

Operational characteristics of an antenna system, such as antenna system 104 and antenna system 108 include its directivity and gain, among others operational attributes. The directivity of an antenna system relates to the spatial coverage of the antenna system, which in part determines the strength of received radio frequency signals based on the physical location and orientation of the transmitter antenna system and of the receiver antenna system. The spatial coverage of an antenna system is further determined based on the number and type of antennas included in the antenna system, signal interference, loss of signal energy due to absorption, and the like. As used herein, an antenna is an individual resonant circuit capable of transmitting or receiving a radio frequency signal. There are many types of antennas, including monopole, dipole, patch, and others. Antenna systems can be further classified based on how signals are provided to one or more antennas, for example beam-forming antennas, spatial multiplexing antennas, and the like.

The preferred embodiment of the antenna system disclosed herein includes two or more patch antennas wherein at least two of the patch antennas do not share a common orientation and an individual patch antenna, or set of patch antennas, can be selectively enabled using a corresponding switch device to control directivity characteristics of the antenna system. Furthermore, an information handling system, such as information handling systems 102 and 106, can include more than one antenna system to provide additional spatial coverage by orienting each antenna system differently from another. In an embodiment, a set of patch antennas are fabricated together on a single flexible printed circuit board. As used herein, a printed circuit board broadly describes a substrate that is substantially insulating to electric current, and on which a conductive material is disposed Antenna system 104 and antenna system 108 preferably operate within the 60 GHz radio frequency band, and more preferably operates within a frequency range extending from approximately 57 GHz to 66 GHz. The Federal Communications Commission (FCC) and other international governing bodies designate the 60 GHz radio frequency band for unlicensed use. However, communications range is limited by atmospheric absorption of signals in the 60 GHz frequency range. For example, communications range can be limited to about 10-20 meters. The 60 GHz radio frequency band is thus best suited for use at in-home and limited-range commercial applications where high-bandwidth capabilities of a 60 GHz communications network are desirable. For example, network bandwidth of approximately 4 gigabits per second (Gb/s) can be implemented that can support transfer of video information between two information handling systems, such as between a personal computer and a video display device. In another embodiment, antenna system 104 and antenna system 108 can operate within other EHF radio frequency bands in the range of approximately 30 GHz to 200 GHz.

The spatial coverage provided by an individual patch antenna that is operating at 60 GHz can be relatively small compared to the spatial coverage that may be provided another type of antennas, such as a monopole antenna, because patch antennas are inherently highly directional. Therefore, the communications range that can be achieved between two information handling systems can be greatly dependent on the mutual orientation of the transmitting antenna and the receiving antenna. The present disclosure describes devices and methods to increase the spatial coverage of an antenna system by including two or more patch antennas at the antenna system, and orienting at least one of the patch antennas differently than the orientation of another patch antenna of the antenna system. A switch is used to select a particular patch antenna of an antenna system for operation based on a preferred field of view of the patch antenna system. Multiple patch antennas can be arrayed in three-dimensional space within an enclosure of an information handling system to provide a broader radio-frequency field of view than can be provided by patch antennas having a co-planar arrangement. Furthermore, the disclosed antenna system can be less expensive to manufacture and can operate with greater power efficiency than a planar phased array beam-forming antenna system, which typically includes an array controller and a power amplifier for each element of the antenna array.

Figure 2:
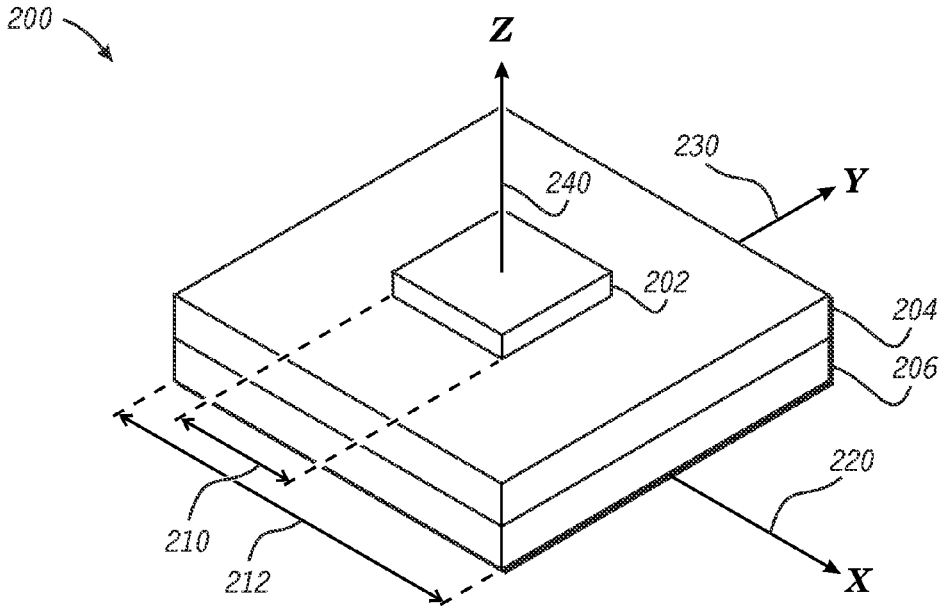
FIG. 2 is a perspective view of a patch antenna for use with an antenna system, such as an antenna system illustrated in FIG. 1.

FIG. 2 shows a patch antenna 200 for use with an antenna system, such as antenna system 104 of FIG. 1. Patch antenna 200 includes a conductive patch 202, a dielectric substrate 204, and a conductive ground plane 206. Connecting leads (not shown at FIG. 2) conduct signals from patch 202 and ground plane 206 to a transmitter, a receiver, or both. The dimensions of patch 202 can be selected based on the intended operating frequency of patch antenna 200. For example, dimension 210 can correspond to approximately one-half of the wavelength of the corresponding radio frequency signal, or approximately 2.5 millimeters in a preferred embodiment. Alternatively, dimension 210 can correspond to approximately one-quarter of the wavelength of the corresponding radio frequency signal.

Patch antenna 200 is substantially flat, having one dimension (thickness) that is small relative to the length and width of the patch antenna. The patch antenna can be rectangular as shown, or can be circular or another shape. Patch antenna 200 defines a plane represented by vector 220 (X) and vector 230 (Y). Each of ground plane 206 and patch 202 are parallel and substantially coplanar to the plane defined by vector 220 and vector 230. The orientation of patch antenna 200 is based on a position in space of the principle plane defined by the patch antenna. As used herein, the orientation of patch antenna 200 is a direction that is normal (perpendicular) to the front side of the patch antenna (the side corresponding to patch 202 relative to the principle plane of the antenna), illustrated by vector 240 (Z).

A patch antenna, also known as a rectangular microstrip antenna, radiates and receives radio frequency signals primarily from the front side of the antenna. Radio frequency signals are generally radiated and received with the greatest efficiency at the front side of the antenna and in a direction normal to the principle plane, illustrated by vector 240 (Z). The dimensions of patch 202 relative to the dimensions of ground plane 206 can vary. For example, dimension 210 can approach the size of corresponding dimension 212 of ground plane 206. Alternatively, the size of patch 202 can be substantially less than that of ground plane 206. The relative size of patch 202 to ground plane 206 determines the radiation pattern characteristics of the patch antenna and consequently the spatial coverage of the patch antenna.

The thickness and dielectric characteristics of dielectric substrate 204 is selected based in part on the operating frequency of patch antenna 200. In an embodiment, dielectric substrate 204 includes a flexible polymer film such as polyester (PET), polyimide (PI), polyethylene naphthalate (PEN), polyetherimide (PEI), fluoropolymers (FEP), copolymers, and the like. A particular dielectric material can be selected based on desired electrical, mechanical, chemical, and thermal properties of the material, such as dielectric constant, flexibility, cost, and the like. Patch 202 and ground plane 206 can include copper, conductive (metal filled) polymer, or another conductive material. Existing printed circuit board fabrication techniques, such as lithographic printing and lamination techniques are suitable for fabricating patch antenna 200. Furthermore, a plurality of patch antennas can be fabricated on a single portion of dielectric material, and the orientation of individual patch antennas can be adjusted relative to one another by bending or thermo-casting the portion of dielectric material at locations between adjacent patch antennas.

Figure 3:
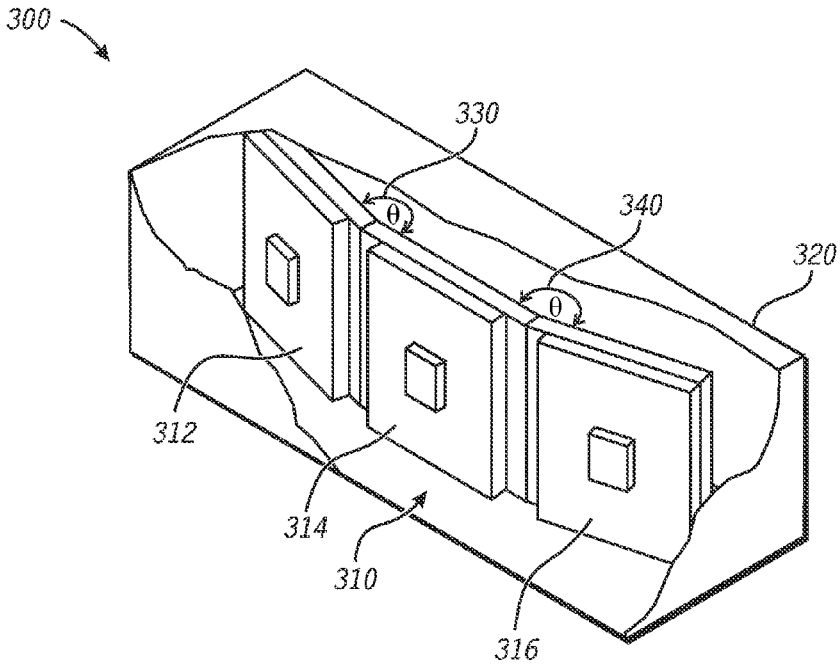
FIG. 3 is a perspective view of an antenna system, such as an antenna system of FIG. 1, in accordance with a specific embodiment of the present disclosure.
Figure 4:
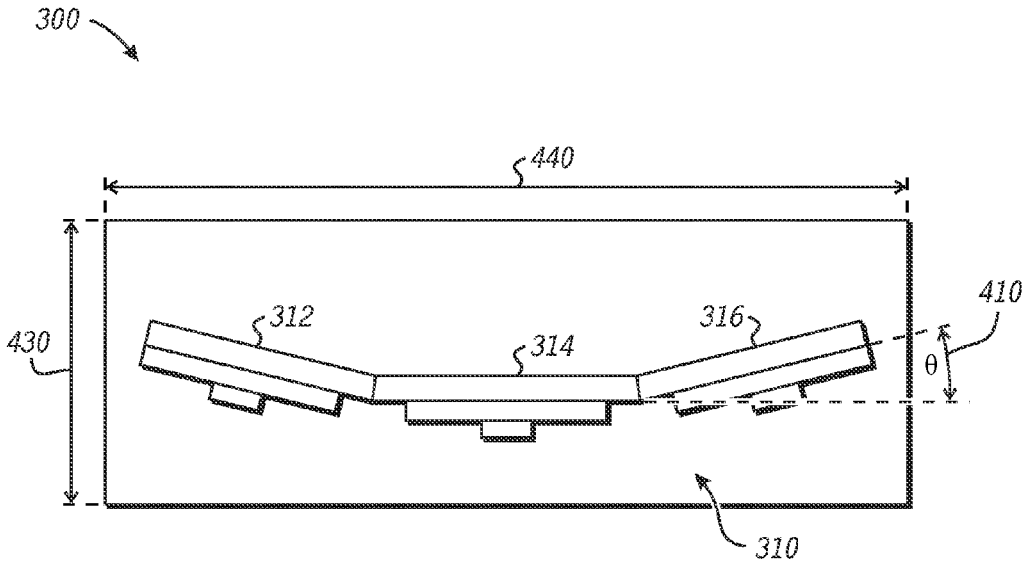
FIG. 4 is a top view of the antenna system of FIG. 3.

FIG. 3 and FIG. 4 show an antenna system 300, such as antenna system 104 of FIG. 1, in accordance with a specific embodiment of the present disclosure. Antenna system 300 includes patch antennas 312, 314, and 316. Each of patch antennas 312, 314, and 316 can be similar to patch antenna 200 of FIG. 2, wherein each includes a conductive patch and a conductive ground plane, separated by a dielectric material. In an embodiment, each of patch antennas 312, 314, and 316 are fabricated or otherwise disposed at a single portion 310 of a flexible printed circuit board, laminate, or another flexible material. For example, a conductive patch and a corresponding conductive ground plane associated with each patch antenna can be disposed at a single portion of dielectric material.

Each patch antenna of patch antennas 312, 314, and 316 is preferably oriented in a different direction relative to one another. For example, the principle plane defined by patch antenna 312 is different from the principle plane defined by patch antenna 314, and a principle plane defined by patch antenna 316 is different from that of patch antennas 312 and 314 so that the virtual planes defined by each antenna intersect. The angular relationship between one patch antenna and another can be selected based on a desired directivity characteristic of each antenna. For example, angle 330 and angle 340 may be 170°, 160°, 100°, or another angle. In an embodiment, angle 330 and angle 340 can be different.

In operation, a plurality of switches (not shown at FIG. 3) selects an individual antenna of patch antennas 312, 314, and 316 to transmit or receive a signal, while the remaining patch antennas are deselected. A selected patch antenna can be enabled based on a location and an orientation of another antenna system associated with another information handling system with which communication is desired. For example, with regard to network system 100 of FIG. 1, a particular patch antenna at antenna system 104 and a particular patch antenna at antenna system 108 each can be selected based on the directivity and spatial coverage of available patch antennas to increase the strength of received signals or to minimize transmission power.

An antenna system can include as few as two patch antennas, or can include a greater number such as four, six, or more. Furthermore, while the orientation of each patch antenna of patch antennas 312, 314, and 316 of FIG. 3 is illustrated to differ only in regards to azimuth (tilted left and right), the orientation of a particular patch antenna can differ in elevation (tilted up and down), or the orientation of a particular patch antenna can differ in both azimuth and elevation relative to another patch antenna. In an embodiment, a plurality of patch antennas can be arranged to provide substantially 360 degrees of spatial coverage. For example, six or more patch antennas can be disposed at all six sides of a cube or at selected external facets of a higher-order polyhedron geometric shape.

Antenna system 300 can include a chassis 320 at which portion 310 is mounted. An information handling system can include more than one antenna system. For example, an antenna system can be included with the base portion of a laptop computer while another antenna system can be located within the display portion. Chassis 320 can include plastic and may include radio frequency permeable materials. For example, chassis 320 can include internal features to physically support portion 310 and to provide and maintain a desired degree of non-planarity of included patch antennas. Spatial coverage provided by antenna system 300 can be greater than may be provided if patch antennas 312, 314, and 316 are oriented in a parallel or co-planar manner.

In another embodiment, one or more of patch antennas of patch antennas 312, 314, and 316 can be implemented as discrete components and each component can be mounted individually at chassis 320. In still another embodiment, one or more patch antennas can be included at disparate locations within an information handling system without the use of a chassis or other ancilatory fixtures or hardware to facilitate mounting of an antenna. For example, leads associated with a patch antenna can be soldered directly to an existing printed circuit board included at the information handling system. Portions of the information handling system, such as an enclosure or internal framework, located near or adjacent to patch antenna system 300 or to an individual patch antenna, can be fabricated using a radio frequency permeable material to minimize signal absorption. In yet another embodiment, patch antenna system 300 or one or more patch antennas or can be mounted at an information handling system in a manner such that the orientation of one or more patch antennas can be adjusted, automatically or by a user of the information handling system.

FIG. 4 shows a top view of antenna system 300 of FIG. 3. Because antenna system 300 is advantageously configured to operate at approximately 60 GHz, the dimensions of chassis 320 can be small enough to be included within portable devices such as cell phones, music players, PDAs, and similar information handling systems. For example, dimension 430 can be about 0.5 centimeters (cm) and dimension 440 can be about 3.0 cm, facilitating installation of antenna system 300 within portable or mobile information handling systems such as laptop computers, PDAs, personal music players, cell phones, and the like.

Figure 5:
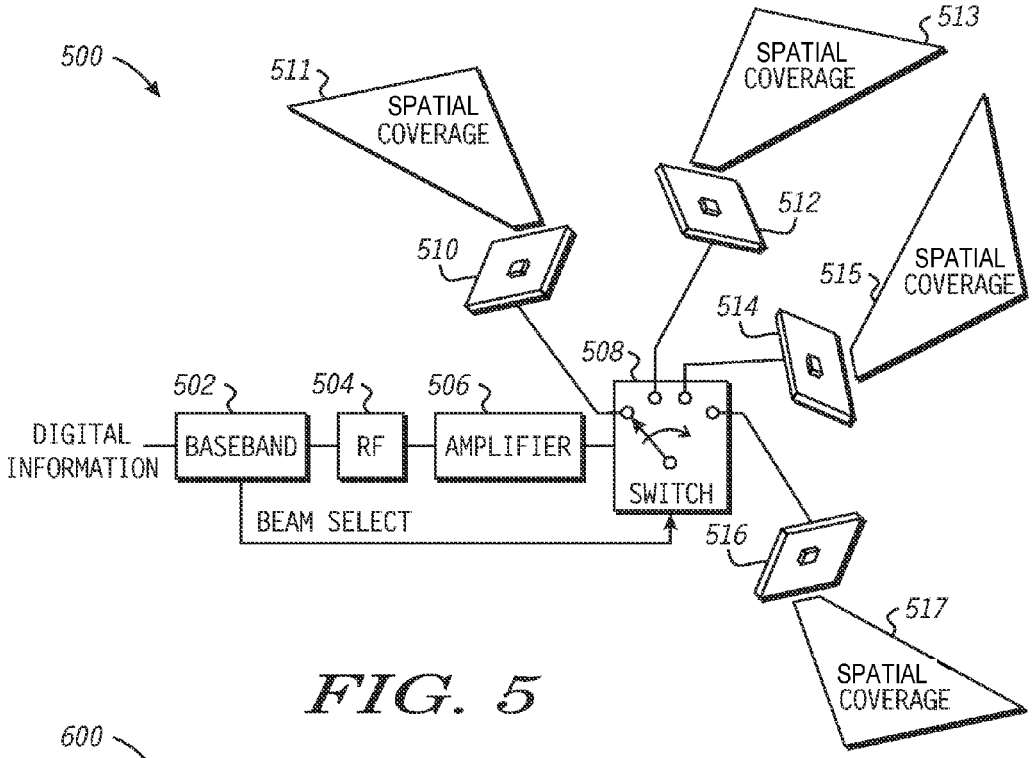
FIG. 5 is a block diagram illustrating a portion of an information handling system, such as an information handling system of FIG. 1, in accordance with a specific embodiment of the present disclosure.

FIG. 5 shows a portion 500 of an information handling system, such as information handling system 102 or information handling 106 of FIG. 1, in accordance with a specific embodiment of the present disclosure. Portion 500 includes a baseband module 502, a radio frequency module 504, an amplifier 506, a switch module 508, a patch antenna 510, a patch antenna 512, a patch antenna 514, and a patch antenna 516. A representation of a spatial coverage and general directivity associated with each patch antenna is also illustrated, with spatial coverage 511, 513, 515, and 517 associated with patch antennas 510, 512, 514, and 516, respectively.

Patch antennas 510, 512, 514, and 516 can be included at an antenna system, such as antenna system 300 of FIG. 3, or individual antennas can be located in disparate locations of information handling system 500. At least one antenna of patch antennas 510, 512, 514, and 516 is preferably oriented in a different direction relative to another antenna. An individual patch antenna can be enabled while the remaining antennas are disabled using switch module 508, to provide selectable directivity.

Baseband module 502 is configured to encode digital information for transmission by information handling system 500 or to decode information that has been received by information handling system 500. Baseband module 502 provides network protocol-layer functions such as packetizing of the digital data information. Baseband module 502 is further operable to configure switch module 508 to select an individual antenna for operation from available patch antennas 510, 512, 514, and 516.

Radio frequency module 504 and amplifier 506 modulate and amplify the approximately 60 GHz radio frequency signal to encode the baseband information and to supply the radio frequency signal to switch module 508 for transmission by a selected one of patch antennas 510, 512, 514, and 516. While operating as a receiver, a radio frequency signal received at a selected patch antenna is detected and demodulated by amplifier 506 and radio frequency module 504, and the information is provided to baseband module 502. Baseband module further decodes the information to provide digital information to other portions of information handling system 500. Modulation methods can include orthogonal frequency-division multiplexing (OFDM), quadrature amplitude modulation (QAM), binary phase-shift keying (BPSK), quadrature phase-shift keying (QPSK), single carrier, or another modulation method.

Switch 508 selects which patch antenna of antennas 510, 512, 514, and 516 is active by completing an electrical connection with the desired antenna, enabling operation of the selected antenna. The remaining antennas are consequently deselected and thus disabled. Switch module 508 can include electromechanical switches such as micro-electromechanical (MEM) switches, semiconductor transistor switches, PIN diodes (diodes with an intrinsic region), or another type of switch suitable for switching radio frequency signals.

Switch 508 can be controlled by baseband module 502. Baseband module 502 can select one of the available patch antennas to enable that patch antenna to transmit or receive a radio frequency signal. Baseband module 502 can employ an antenna selection algorithm whereby a particular patch antenna is selected at information handling system 500, while a similar process is conducted at another information handling system with which communication is established. For example, one information handling system can be configured as a master device while the other information handling system is designated as a slave device. The master device and slave device can coordinate selection of a respective antenna at each system in a recursive manner based on an evaluation of an intensity of a received signal, and thereby determine a preferred antenna to select at each of the information handling systems.

Figure 6:
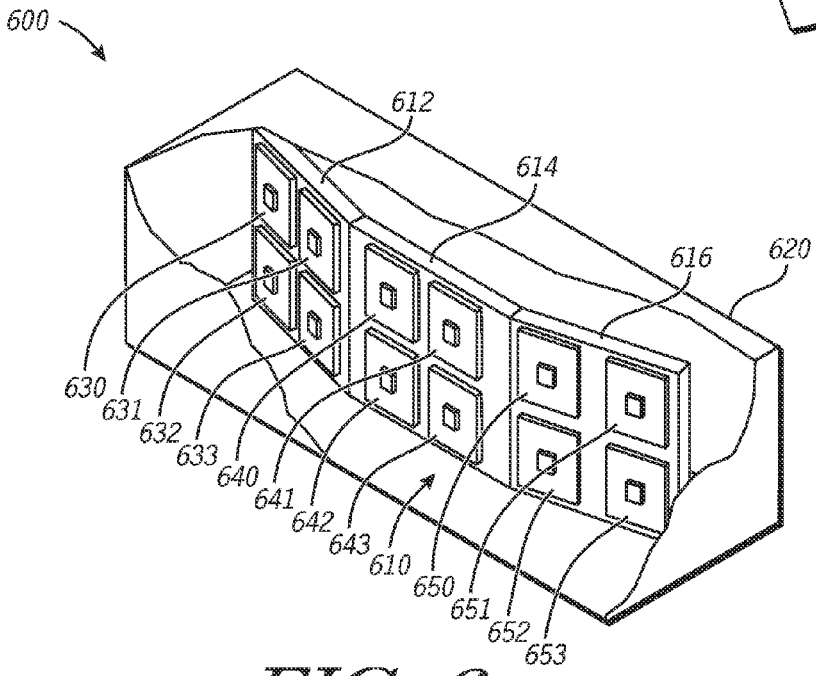
FIG. 6 is a perspective view of an antenna system, such as an antenna system of FIG. 1, in accordance with a specific embodiment of the present disclosure.

FIG. 6 shows an antenna system 600, such as antenna system 104 of FIG. 1 in accordance with a specific embodiment of the present disclosure. Antenna system 600 is similar to antenna system 300 of FIG. 3 except antenna system 600 includes a greater number of patch antennas than does patch antenna system 300. Antenna system 600 includes twelve patch antennas. Patch antennas 630, 631, 632, and 633 are included at portion 612 and are mutually coplanar. Patch antennas 640, 641, 642, and 643 are included at portion 614 and are mutually coplanar. Patch antennas 650, 651, 652, and 653 are included at portion 616 and are mutually coplanar. In an embodiment, each patch antenna can be fabricated or otherwise disposed at a single portion 610 of a flexible printed circuit board or similar material. Each portion of portions 612, 614, and 616, and consequently each set of four patch antenna respectively disposed thereon, is oriented in a different direction relative to one another.

During operation, a switch module such as switch module 508 of FIG. 5 can simultaneously enable all four patch antennas included at one selected portion of portions 612, 614, and 616. Providing additional patch antennas at each portion can increase the effective antenna gain relative to a single patch antenna. One skilled in the art will appreciate that a greater or a fewer number of patch antennas can be included at each portion based on the amount of antenna gain that is desired, or based on other criteria.

Figure 7:
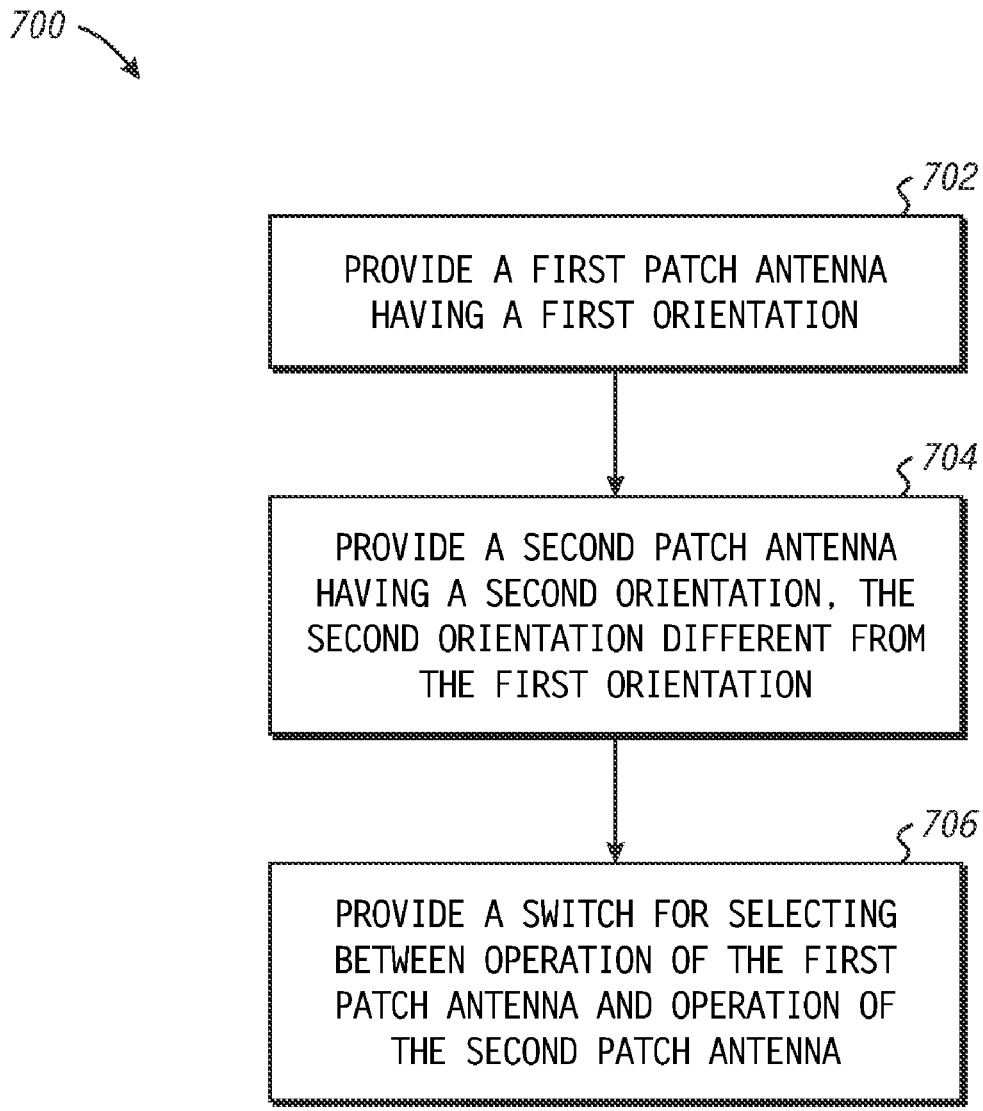
FIG. 7 is a flow chart illustrating a method in accordance with a specific embodiment of the present disclosure.

FIG. 7 shows a method 700 in accordance with a specific embodiment of the present disclosure. The flow begins at node 702 where a first patch antenna is provided at a first orientation. For example, patch antenna 312 of FIG. 3 can be disposed at an information handling system, such as information handling system 102 of FIG. 1. The flow proceeds to node 704 where a second patch antenna is provided at a second orientation, the second orientation different from the first orientation. For example, patch antenna 314 of FIG. 3 can be disposed at the information handling system so that patch antenna 314 is oriented differently than patch antenna 312. The difference in orientation between the first and second patch antenna can include a difference in azimuth, elevation, or both azimuth and elevation. The first and second patch antenna can be disposed at a single portion of dielectric, such as a flexible printed circuit board. The flow proceeds to node 706 where a switch is provided to select between operation of the first patch antenna and operation of the second antenna. For example, switch module 508 of FIG. 5 provides continuity between a radio frequency signal provided by amplifier 506 and a selected individual patch antenna of patch antennas 510, 512, 514, and 516.

An antenna system similar to antenna system 300 of FIG. 3 was simulated, and the spatial coverage validated. The simulated assembly was virtually mounted within a 30 mm by 10 mm space. The size of the assembly allows it to be placed at a variety of physical locations within a laptop computer. Simulations indicate that the antenna system, wherein the orientation of each patch antenna is ten degrees relative to an adjacent antenna, provides spatial coverage of approximately 210 degrees, azimuth. This is more than the maximum 180 degrees possible with a traditional planar antenna. The primary advantages of the antenna system described herein is reduced cost, reduced complexity, and reduced operating power compared to that of an on-chip multi-element phased array antenna assembly utilizing electronic beam steering. The antenna system also provides greater coverage than a phased array antenna.

Figure 8:
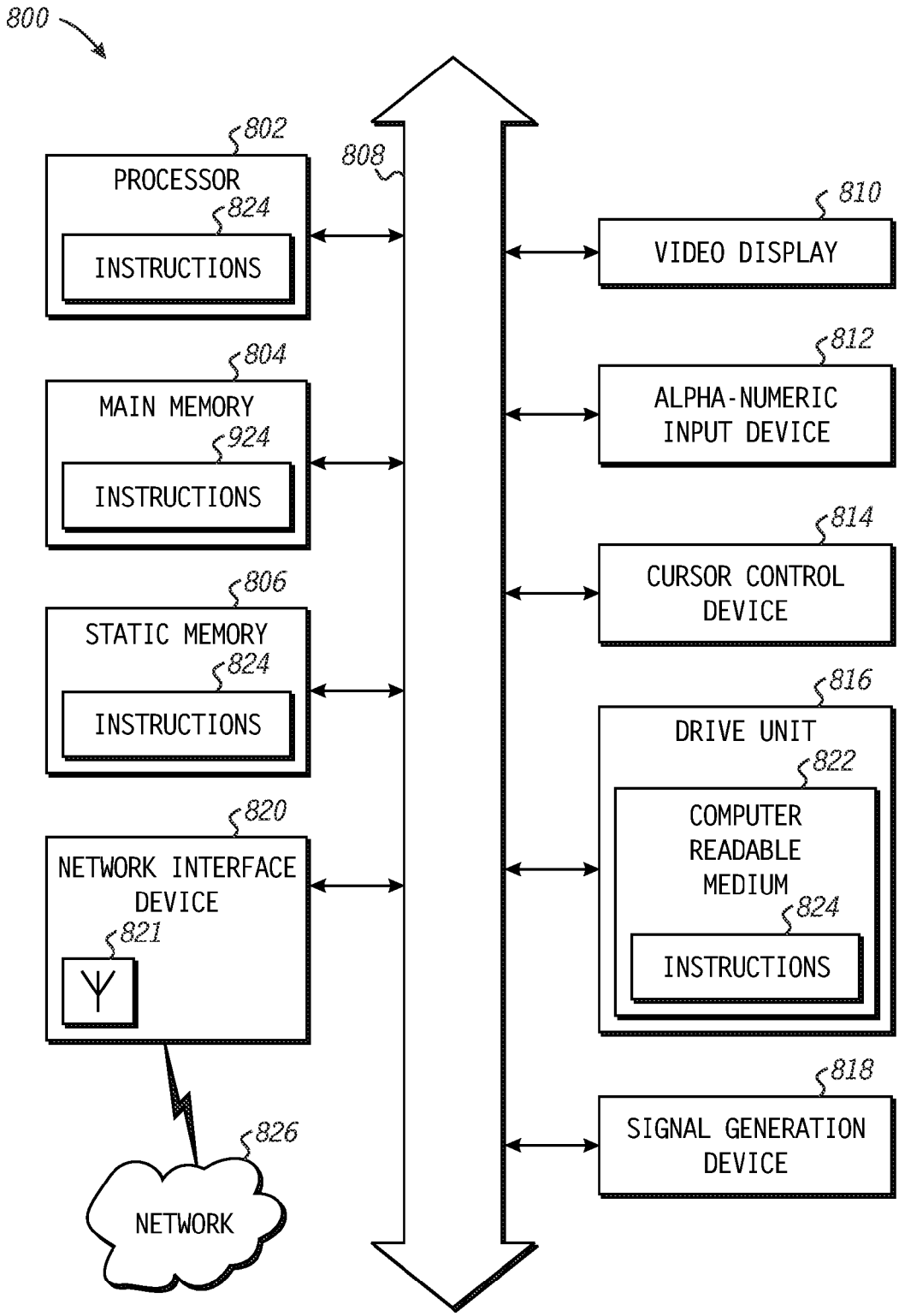
FIG. 8 is a block diagram of an information handling system, such as an information handling system of FIG. 1, in accordance with a specific embodiment of the present disclosure.

FIG. 8 shows an information handling system 800, such as information handling system 102 of FIG. 1, in accordance with a specific embodiment of the present disclosure. Information handling system 800 can include a set of instructions that can be executed to cause information handling system 800 to perform one or more methods or computer based functions. Information handling system 800 may operate as a standalone device or may be connected, e.g., using a network, to other information handling systems or peripheral devices.

In a networked deployment, information handling system 800 may operate in the capacity of a server or as a client user computer in a server-client user network environment, or as a peer computer system in a peer-to-peer (or distributed) network environment. Information handling system 800 can also be implemented as or incorporated into various devices, such as a personal computer (PC), a communications device, a web appliance, a network router, switch or bridge, or any other machine capable of executing a set of instructions (sequential or otherwise) that specify actions to be taken by that machine. In a particular embodiment, information handling system 800 can be implemented using electronic devices that provide voice, video or data communication. Further, while an exemplary information handling system 800 is illustrated, the term "system" shall also be taken to include any collection of systems or sub-systems that individually or jointly execute a set, or multiple sets, of instructions to perform one or more computer functions.

Information handling system 800 may include a processor 802, e.g., a central processing unit (CPU), a graphics processing unit (GPU), or both. Moreover, information handling system 800 can include a main memory 804 and a static memory 806 that can communicate with each other via a bus 808. As shown, information handling system 800 may further include a video display unit 810, such as a liquid crystal display (LCD), an organic light emitting diode (OLED), a flat panel display, a solid state display, or a cathode ray tube (CRT). Additionally, information handling system 800 may include an input device 812, such as a keyboard, and a cursor control device 814, such as a mouse. Information handling system 800 can also include a disk drive unit 816, a signal generation device 818, such as a speaker or remote control, and a network interface device 820. Network interface device 820 can provide wired, wireless, or both wired and wireless network support. Network interface device 820 includes an antenna system 821 operable to transmit, receive, or both transmit and receive radio frequency signals to provide wireless communication with another information handling system.

In a particular embodiment, as depicted in FIG. 8, disk drive unit 816 may include a computer-readable medium 822 in which one or more sets of instructions 824, for example, software, can be embedded. Further, instructions 824 may embody one or more of the methods or logic as described herein. In a particular embodiment, instructions 824 may reside completely, or at least partially, within main memory 804, static memory 806, and/or within processor 802 during execution by information handling system 800. Main memory 804 and processor 802 also may include computer-readable media. Network interface device 820 can provide connectivity to a network 826, for example, a wide area network (WAN), a local area network (LAN), or other network.

In an alternative embodiment, dedicated hardware implementations such as application specific integrated circuits, programmable logic arrays and other hardware devices can be constructed to implement one or more of the methods described herein. Applications that may include the apparatus and systems of various embodiments can broadly include a variety of electronic and computer systems. One or more embodiments described herein may implement functions using two or more specific interconnected hardware modules or devices with related control and data signals that can be communicated between and through the modules, or as portions of an application-specific integrated circuit. Accordingly, the present system encompasses software, firmware, and hardware implementations.

Although only a few exemplary embodiments have been described in detail above, those skilled in the art will readily appreciate that many modifications are possible in the exemplary embodiments without materially departing from the novel teachings and advantages of the embodiments of the present disclosure. Accordingly, all such modifications are intended to be included within the scope of the embodiments of the present disclosure as defined in the following claims.

What is claimed is:

1. A device comprising:

a first patch antenna disposed at a dielectric substrate, the first patch antenna defining a first principle plane;

a second patch antenna disposed at the dielectric substrate, the second patch antenna defining a second principle plane, an orientation of the second principle plane being different from an orientation of the first principle plane, and wherein the dielectric substrate is an insulating layer of a single portion of flexible printed circuit board; and a switch coupled to the first patch antenna and to the second patch antenna, the switch to select between operation of the first patch antenna and operation of the second patch antenna.

2. The device of claim 1 wherein the difference in orientation includes a variation in both azimuth and in elevation.

3. The device of claim 1 wherein the first patch antenna and the second patch antenna are operable to transmit or receive radio signals, the radio signals having a frequency of between 56 GHz and 67 GHz.

4. The device of claim 1 wherein the switch is operable to conduct a radio frequency signal to a selected patch antenna.

5. A method comprising:

providing a first patch antenna at a dielectric substrate, the first patch antenna having a first orientation;

providing a second patch antenna at the dielectric substrate, the second patch antenna having a second orientation, the second orientation different from the first orientation; and providing a switch for selecting between operation of the first patch antenna and operation of the second patch antenna, the switch coupled to a radio frequency module, the radio frequency module operable to provide a modulated radio frequency signal in response to information provided by a baseband module.

6. The method of claim 5 wherein the dielectric substrate is an insulating layer of a single portion of printed circuit board.

7. The method of claim 5 wherein the printed circuit board is flexible.

8. The method of claim 5 wherein the first patch antenna and the second patch antenna are operable to transmit or receive radio signals having a frequency of between 56 GHz and 67 GHz.

9. The method of claim 5 further comprising providing a third patch antenna at the dielectric substrate, the third patch antenna having a third orientation, the third orientation different from the first orientation and different from the second orientation.

10. The method of claim 5 wherein the difference between the first orientation and the second orientation is less than 50 degrees.

11. The method of claim 5 wherein selecting further comprises enabling conduction of a radio frequency signal to a selected patch antenna.

12. The method of claim 5 wherein providing the first patch antenna comprises providing the first patch antenna at a personal computer.

13. An information handling system comprising:

a baseband module;

a radio frequency module coupled to the baseband module, the radio frequency module operable to provide a modulated radio frequency signal in response to information provided by the baseband module;

a switch having an input coupled to the radio frequency module, the switch operable to provide a signal received at the input to a first output or to a second output based on a switch select signal received from the baseband module;

a first patch antenna disposed at a dielectric substrate, the first patch antenna coupled to the first output of the switch, the first patch antenna having a first orientation; and a second patch antenna disposed at the dielectric substrate, the second antenna coupled to the second output of the switch, the second patch antenna having a second orientation, the second orientation different from the first orientation.

14. The information handling system comprising of claim 13 wherein the dielectric substrate is an insulating layer of a flexible printed circuit board.

15. The information handling system comprising of claim 13 wherein the first patch antenna and the second patch antenna are operable to transmit or receive radio signals having a frequency of between 56 GHz and 67 GHz.

16. The information handling system of claim 13 wherein the difference in orientation includes a variation in both azimuth and in elevation.

17. The information handling system of claim 13 wherein the first patch antenna and the second patch antenna are operable to transmit or receive radio signals, the radio signals having a frequency of between 30 GHz and 200 GHz.

18. The information handling system of claim 13 further comprising a third patch antenna disposed at the dielectric substrate, the third patch antenna defining a third principle plane, an orientation of the third principle plane different from the orientation of the first principle plane and different from the orientation of the second principle plane.

19. The information handling system of claim 13 wherein the difference in orientation between the first principle plane and the second principle plane is less than 50 degrees.

20. The information handling system of claim 13 further comprising a third patch antenna and a fourth patch antenna, the third and fourth patch antenna disposed at the dielectric substrate, the third patch antenna coplanar with the first patch antenna and the fourth patch antenna coplanar with the second patch antenna.

* * * * *